US005967869A

United States Patent [19]

Wiggins

[11] Patent Number: 5,967,869

[45] Date of Patent: Oct. 19, 1999

[54] SELF-RIGHTING INFLATABLE LIFE RAFT

[76] Inventor: Renard Jonas Wiggins, Unit #8 32 Williams Rd., Prahran Victoria, Australia, 3181

[21] Appl. No.: 08/496,873

[22] Filed: Jun. 30, 1995

[51] Int. Cl.[6] ..... B63B 35/58

[52] U.S. Cl. ..... 441/38; 114/348

[58] Field of Search ..... 441/38, 40, 35; 114/348, 349, 345, 360

[56] References Cited

U.S. PATENT DOCUMENTS 4,998,900 3/1991 Wright ..... 441/38

FOREIGN PATENT DOCUMENTS 636776 5/1950 United Kingdom ..... 441/38

*Primary Examiner*—Jesus D. Sotelo

[57] ABSTRACT

A self-righting inflatable life raft having a raft body formed by inflatable sidewalls, a floor above a bottom of the sidewalls, a line of rotation of the raft defined by the outer perimeter of the raft body about which the raft body rotates on the surface of the water when moved from an inverted position to an upright position. The center of gravity of the raft body is spaced a first predetermined distance from the line of rotation and displaced horizontally from the line of rotation when the raft is inverted. At least three inflatable spaced apart tube members extending upwardly and outwardly from the perimeter of the raft body at an angle from the perpendicular to the raft body to a sufficient degree and having a buoyancy sufficient such that the moment exerted on the raft about the line of rotation by the weight of the raft acting through its center of gravity causes the raft body to topple by gravity to an upright position. A tie fixed to and extending between two points on the raft limits separation of the two points to the length of the tie during and after inflation of the tube members, which two points are chosen to inhibit distortion or collapse of the tube members from their desired positions when inflated.

12 Claims, 2 Drawing Sheets

SELF-RIGHTING INFLATABLE LIFE RAFT

TECHNICAL FIELD

This invention relates to an inflatable life raft having inflatable tubes dimensioned and positioned to cause the life raft to turn upright in the water without assistance if the raft inflates in an inverted position or to return an inflated raft to an upright position if it is subsequently overturned.

BACKGROUND ART

In U.S. Pat. No. 4,998,900, and the corresponding international patent no PCT/CA91/00218 (publication no WO-91/19642), there is described and illustrated a self-righting inflatable life raft having upwardly and outwardly extending inflatable tubes. These tubes are arranged to cause the life raft to be unstable if inverted. In particular, the center of gravity of the life raft if inverted will be outside of the bottom of the life raft so that it will by gravity topple back to the upright position. The complete disclosures of the US and international patent specifications are incorporated herein by reference so that the disclosures thereof are to be read as part of this specification and the present invention is to be understood and construed in the context of those disclosures of prior art.

If the inflatable tubes in these prior constructions do not inflate or, after inflation, are subsequently collapsed or distorted, they may not adopt their desired positions extending upwardly and outwardly from the side walls of the main body, sufficient to make the life raft topple to the upright position.

SUMMARY OF THE INVENTION

It is an object of the present invention to provide a life raft which can reliably return to an upright position if inverted.

According to the present invention there is provided a self-righting inflatable life raft, comprising: a raft body having inflatable sidewalls, a floor above a bottom of said sidewalls and a line of rotation defined at the outer perimeter of said raft body upon which said raft body rotates on the surface of water when moved from an inverted position to an upright position, said raft body having a center of gravity which is spaced a first predetermined distance from said line of rotation and displaced horizontally from said line of rotation when said raft is inverted; and at least three inflatable spaced apart tube members, each member extending upwardly and outwardly from a perimeter of said raft body at an angle from the perpendicular to said raft body sufficiently great and having a buoyancy sufficient such that the moment exerted on said raft about said line of rotation by its weight acting through its center of gravity causes said raft body to topple by gravity to an upright position, the improvement comprising a tie fixed to and extending between two points to the length of the tie during and after inflation of the tube members, the two points being chosen to inhibit distortion or collapse of the tube members from their desired positions when inflated.

The tie may extend between a first point on one of the tube members and a second point on the raft body. Alternatively, the tie may extend between a first point on one of the tube members and a second point on a different one of the tube members.

Preferably, the inflatable tube member converge towards a common connecting member spaced upwardly from said raft body, the tube member inducing top tubular portions extending from the outermost extent of the tube members in a direction upwards and inwards towards the common connecting member. In this embodiment the tie may extend from a first point on a top tubular portion of one of the tube members and a second point on the raft body. Alternatively, the tie may extend from a first point on the common connecting member to a second point on the raft body.

In this embodiment, the common connecting member preferably comprises an inflatable tube extending generally horizontally, at least two of the tube members being connected to the horizontally extending inflatable tube at points spaced along its length. In this construction, the tie may extend from a first point at one end of the horizontally extending inflatable tube and a second point on the raft body.

The tie may comprise a flexible substantially inextensible line. Alternatively, the tie may comprise an inflatable tube which extends in a straight line between the two points when inflated.

Preferably there are provided a plurality of the ties, at least two of the ties being symmetrically arranged relative to the arrangement of the tube members so that one of the two ties inhibits distortion or collapse of the tube member in one direction and the other symmetrically arranged tie inhibits distortion or collapse of the tube members in the symmetrically opposite direction.

The present invention also provides a self-righting inflatable life raft, comprising: a raft body including inflatable sidewalls having an upper edge, said sheer line being defined substantially between said sidewalls at said upper edge, said sheer line having a midpoint substantially centered between said sidewalls; a means for righting said raft body including a plurality of inflatable tube portions each having a central longitudinal axis which extends from said upper edge to a first predetermined position upwardly and outboard from the upper edge and which then extends inboard to centrally converge with a connecting member connected to others of said plurality of inflatable tube portions at a second predetermined position above said sheer line, said first position being spaced outboard at least a horizontal distance substantially determined by the equation:

$$\frac{A}{\mathrm{Cos}B^{\circ}}$$

said first position being spaced upwardly above the sheer line at least a vertical distance substantially determined by the equation:

$$\sqrt{(C+(D\cdot\tan E^{\circ}))^2-C^2}$$

said second position being spaced vertically above the sheer line midpoint at least a distance substantially determined by the equation:

$$Y=C'+(D\cdot\tan E^{\circ})$$

where.

A=the distance from the sheer line midpoint to the axial center of the tube portion at the upper edge of said sidewalls; and B=one-half the angle in degrees between the axial center of adjacent tube portions at said upper edge of said sidewalls; and C=one-half the outer beam being the lateral distance across the raft from one outermost side to the other;

C'=one-half the minimum lateral distance across the raft from one outermost side to the other;

D=the vertical height of said sidewalls; and

E=the minimum angle in degrees beyond vertical that the sheer line must be tilted to cause the raft body to topple by gravity to an upright position, said inflatable tube portions being sized to provide buoyancy at least equal to the mass of the raft;

Y=distance from the beam or sheer line midpoint horizontally to the point at which the sheer line would intersect the line which extends at an angle E.

The improvement comprising of a tie fixed to and extending between two points on the life raft to limit separation of the two points to the length of the tie during and after inflation of the tube members the two points being chosen to inhibit distortion or collapse of the tube members from their desired positions when inflated.

Other features and advantages of the present invention will become apparent from a reading of the following best mode of carrying out the invention and inspection of the accompanying drawings and claims, all of which are incorporated into this disclosure by specific reference.

BRIEF DESCRIPTION OF THE DRAWINGS

Life reference numeral are used to indicate like parts throughout the various figures of the drawing, and wherein.

BEST MODE FOR CARRYING OUT THE INVENTION

Figure 1:
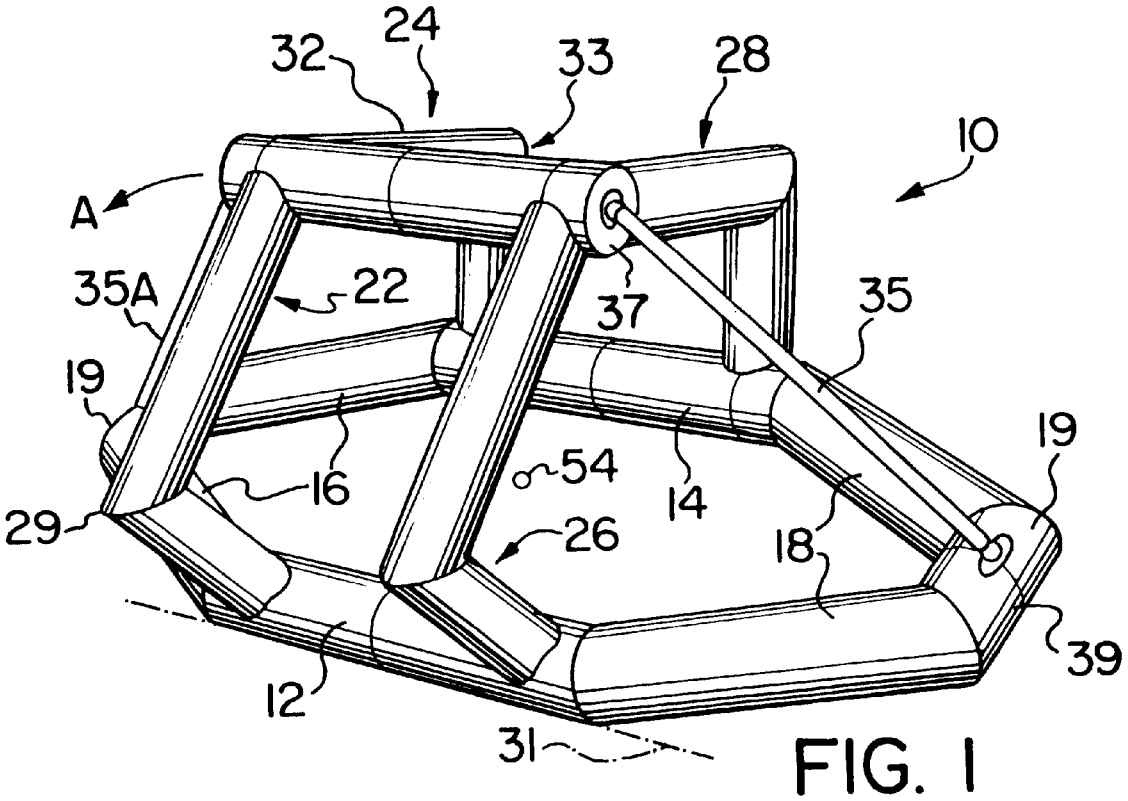
FIG. 1 is a schematic perspective view of an elongated self-righting life raft according to a preferred embodiment of the present invention.

Referring to FIG. 1, the life raft includes a raft body comprising side walls 12, 14, 16, 18 and relatively short end walls 19 and a floor panel 20. The walls 12, 14, 16, 18 and 19 are made of inflatable tubes in conventional fashion. Tubular inflated members 22, 24, 26, 28, extend upwardly from the side walls 12, 14, initially extending outwardly to outermost points 29 and then inwardly and upwardly to the common connecting member 33. The member 33 comprises an inflatable tube extending generally horizontally in the longitudinal direction of the main body. The raft 10 has a center of gravity 54 which is outside and above a line of rotation 31 (the water line) so that the raft rotates about line 31 in returning to the upright condition.

Since the canopy structure consisting of inflatable members 22, 24, 26, 28 and 33 illustrated in FIG. 1 may be susceptible to distortion or collapsing in the longitudinal direction, i.e. in the general direction of arrow A in FIG. 1, the life raft includes a tie 35 fixed to and extending between points 37 and 39. The point 37 is provided at the end of the horizontally extending inflatable tube 33 and the point 39 is provided on the short end wall 19 of the raft body. The tie 35 is illustrated as a flexible strap fixed at its opposite ends by suitable reinforcing patches secured to the material of the inflatable tubes 33 and 39. The tie or strap 35 is flexible so as to collapse and be packed with the life raft when it is deflated but is substantially inextensible so as to inhibit distortion or collapse of the canopy structure in the direction of arrow A. A symmetrically arranged tie 35A is provided at the opposite longitudinal end of the life raft for the same purpose.

Although the ties 35, 35A are illustrated as flexible straps, they could be made for example as cables, or even rigid links, such as a tie being composed of a number of rigid rods hinged together so that when the life raft is erected by inflation, the links adopt a straight line configuration the same as the illustrated strap 35.

Figure 2:
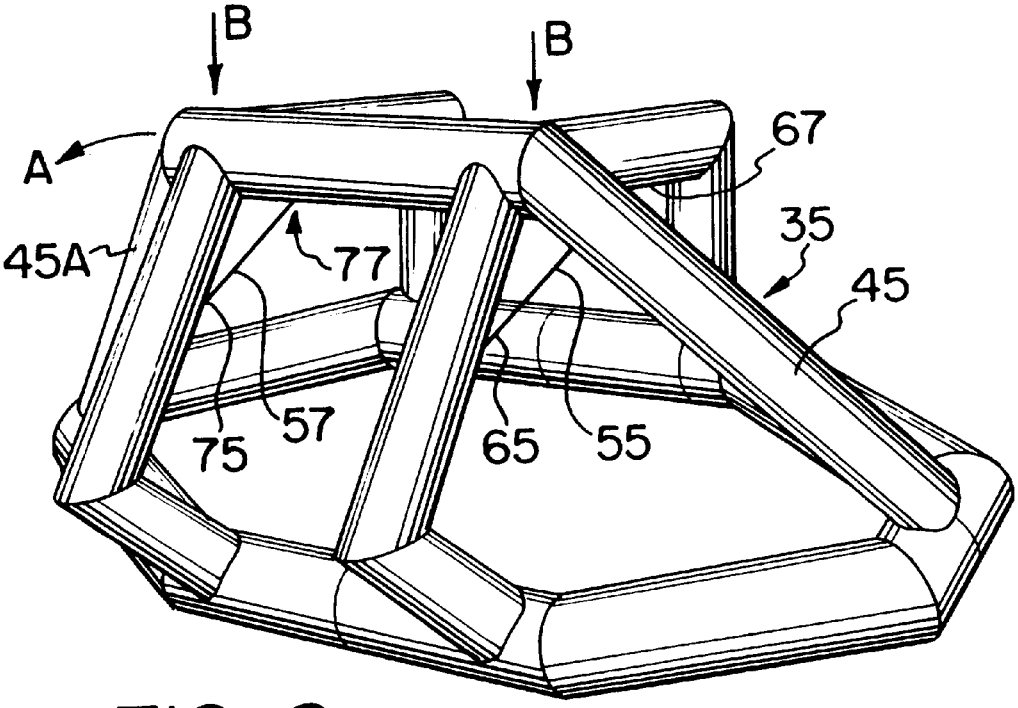
FIG. 2 is a perspective view of an alternative embodiment of life raft according to the present invention.

In FIG. 2 there is illustrated a variation of the embodiment of FIG. 1. In particular, in FIG. 2 the tie 35 comprises an inflatable tube 45 which is inflated simultaneously with the other inflatable components of the life raft. The inflatable tube 45 functions in the same manner as the tie strap 35 of FIG. 1 by inhibiting distortion or collapse of the canopy structure from the illustrated position in the direction of arrow A. As in the embodiment of FIG. 1, the life raft in FIG. 2 has a symmetrically arranged inflatable tube 45A at the opposite end of the life raft.

Also shown in FIG. 2 are lateral ties 55, 57, these extend between point 65, 67 and 75, 77 respectively located on the upper portions 32 of opposed tube members 26, 28 and 22, 24 respectively. The lateral ties 55, 57 inhibit distortion or collapse of the tube members in a direction away from each other transverse to the general longitudinal line of the elongated life raft, e.g. as would occur upon distortion of the copy structure of the downward direction illustrated by arrow B. The lateral ties 55, 57 can be used in addition to the ties 35 and can be made of similar materials such as flexible lines, straps or rigid links.

Figure 3:
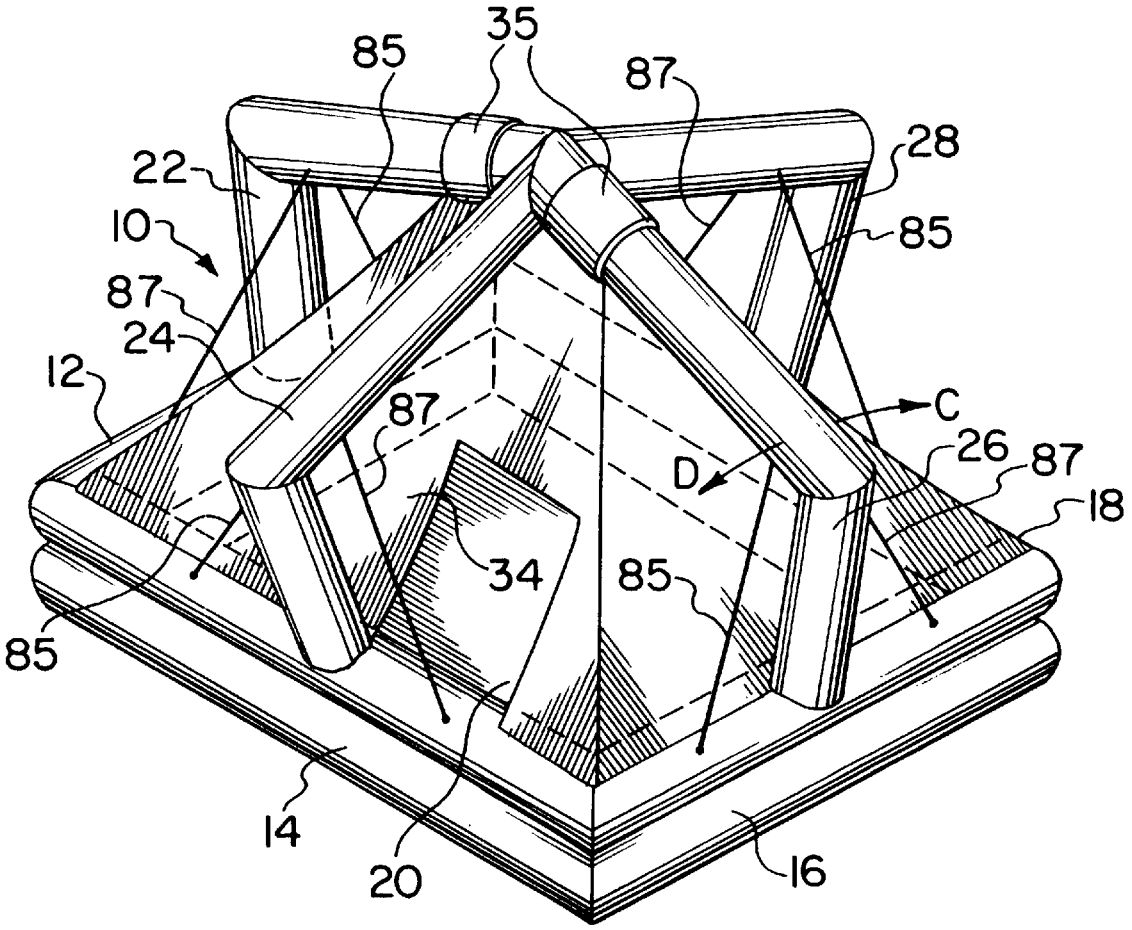
FIG. 3 is a perspective view of a further possible embodiment of life raft according to the present invention.

In FIG. 3 each tube member 22, 24, 26, 28 has a respective pair of ties or struts 85, 87 extending from the upper portions 32 to points on the main body spaced on opposite sides of the lower ends of the respective tube members. These ties 85, 87 inhibit distortion or collapse of the tube members in lateral directions indicated by the arrows C, D respectively.

The various ties 35, 45, 55, 57, 85, 87 illustrated in the drawings can be all used simultaneously in the one life raft construction although this may not be necessary. For example the ties 35, 35A in FIG. 1 provide substantially the same function as the ties 85, 87 would provide of associated with each of the tube members 22, 24, 26, 28 in FIG. 1.

It will be seen that the life raft according to the present invention can enabale improved reliability in self-righting of the life raft, particularly if it is inverted when it is first being inflated. When this is occurring, the tendency of the inflatable tube members to fail to inflate to their finally desired operative positions and cause the life raft to invert. However, the provision of ties between points whose separation is increased upon distortion or collapsing facilitates correct erection and therefor self-righting of the raft.

I claim:

1. A. self-righting inflatable life raft, comprising:

a raft body having inflatable sidewalls, a floor above a bottom of said sidewalls and a line of rotation defined at the outer perimeter of said raft body upon which said raft body rotated on the surface of water when moved from an inverted position to an upright position, said raft body having a center of gravity which is spaced a first predetermined distance from said line of rotation and displaced horizontally from said line of rotation when said raft is inverted; and at least three inflatable spaced apart tube members each member extending upwardly and outwardly from a perimeter of said raft body at an angle from the perpendicular to said raft body sufficiently great and having a buoyancy sufficient such that the moment exerted on said raft about said line of rotation by its weight acting through its center of gravity causes said raft body to topple by gravity to upright position, the improvement comprising a tie fixed to and extending between two points on the life raft to limit separation of the two points to the length of the tie during and after inflation of the tube members, the two points being chosen to inhibit distortion or collapse of the tube members from their desired position when inflated.

2. A life raft as claimed in claim 1 wherein the tie extends between a first point on one of the tube members and a second point on the raft body.

3. A life raft as claimed in claim 1 wherein the tie extends between a first point on one of the tube members and a second point on a different one of the tube members.

4. A life raft as claimed in claim 1, wherein said inflatable tube members converge towards a common connecting member spaced upwardly from said raft body, the tube members including top tubular portions extending from the outermost extent of the tube members in a direction upwards and inwards towards the common connecting member.

5. A life raft as claimed in claim 4 wherein the tie extends from a first point on a top tubular portion of one of the tube members and a second point of the raft body.

6. A life raft as claimed in claim 4 wherein the tie member extends from a first point on the common connecting member to a second point on the raft body.

7. A life raft as claimed in claim 4 wherein the common connecting member comprises an inflatable tube extending generally horizontally, at least two of the tube members being connected to the horizontally extending inflatable tube at points spaced along its length.

8. A life raft as claimed in claim 7 wherein the tie extends form a first point at one end of the horizontally extending inflatable tube and a second point on the raft body.

9. A life raft as claimed in claim 1 wherein the tie comprises a flexible substantially inextensible line.

10. A life raft as claimed in claim 1 wherein the tie comprises an inflatable tube which extends in a straight line between the two points when inflated.

11. A life raft as claimed in claim 1 wherein there are provided a plurality of said ties, at least two of the ties being symmetrically arranged relative to the arrangement of the tube members so that one of the two ties inhibits distortion or collapse of the tube members in one direction and the other symmetrically arranged tie inhibits distortion or collapse of the tube members in the symmetrically opposite direction.

12. A self-righting inflatable life raft, comprising a raft body including inflatable sidewalls having an upper edge and a sheer line being defined substantially between said sidewalls at said upper edge, said sheer line having a midpoint substantially centered between said sidewalls; a means for righting said raft body including a plurality of inflatable tube portions each having a central longitudinal axis which extends from said upper edge to a first predetermined position upwardly and outboard from the upper edge and which then extends inboard to centrally converge with a connecting member connected to others of said plurality of inflatable tube portions at a second predetermined position above said sheer line, said first position being spared outboard at least a horizontal distance substantially determined by the equation:

$$\frac{A}{\mathrm{Cos}B^{\circ}}$$

said first position being spaced upwardly above the sheer line at least a vertical distance substantially determined by the equation:

$$\sqrt{(C+(D\cdot\tan E^{\circ}))^2-C^2}$$

said second position being spaced vertically above the sheer line midpoint at least a distance substantially determined by the equation:

$$Y=C'+(D\cdot\tan E^{\circ})$$

where:

A=the distance from the sheer line midpoint to the axial center of the tube portion at the upper edge of said sidewalls; and B=one half the angle in degrees between the axial center of adjacent tube portions at said upper edge of said sidewalls; and C=one-half the outer beam being the lateral distance across the raft from one outermost side to the other;

$C^1$=one-half the minimum lateral distance across the raft from one outermost side to the other;

D=the vertical height of said sidewalls; and

E=the minimum angle in degrees beyond vertical that the sheer line must be tilted to cause the raft body to topple by gravity to an upright position; said inflatable tube portions being sized to provide buoyancy at least equal to the mass of the raft;

Y=distance from the beam or shear line midpoint horizontally to the point at which the sheer line would intersect the line which extends at an angle E; the improvement comprising a tie fixed to and extending between two points on the life raft to limit separation of the two points to the length of the tie during and after inflation of the tube members, the two points being chosen to inhibit distortion or collapse of the tube members from their desired positions when inflated.

* * * * *